US007445001B2

(12) United States Patent
Sikora

(10) Patent No.: US 7,445,001 B2
(45) Date of Patent: Nov. 4, 2008

(54) COIL-ON-PLUG IGNITION TERMINAL

(75) Inventor: Kenneth R. Sikora, Fort Wayne, IN (US)

(73) Assignee: Group Dekko Inc, Kendallville, IN (US)

( * ) Notice: Subject to any disclaimer, the term of this patent is extended or adjusted under 35 U.S.C. 154(b) by 0 days.

(21) Appl. No.: 11/763,821

(22) Filed: Jun. 15, 2007

(65) Prior Publication Data

US 2008/0006255 A1 Jan. 10, 2008

Related U.S. Application Data

(60) Provisional application No. 60/813,833, filed on Jun. 15, 2006.

(51) Int. Cl.
*H01F 38/12* (2006.01)
*H01F 38/14* (2006.01)

(52) U.S. Cl. ..... 123/634; 123/635

(58) Field of Classification Search ..... 123/634, 123/635, 169 R, 633, 647; 439/125–128, 439/843–848; 29/748
See application file for complete search history.

(56) References Cited

U.S. PATENT DOCUMENTS 3,141,724 A * 7/1964 Raymond ..... 439/777
3,246,284 A * 4/1966 Farison ..... 439/851
3,404,368 A * 10/1968 Roberts et al. ..... 439/866
3,546,665 A * 12/1970 Zak ..... 439/825
3,793,616 A * 2/1974 Moehrke ..... 439/854
4,497,532 A 2/1985 Bezusko et al. ..... 339/112
4,758,189 A * 7/1988 Draxler ..... 439/848
4,768,477 A 9/1988 Richardson ..... 123/169
5,003,958 A 4/1991 Yoneyama et al. ..... 123/635
5,060,624 A 10/1991 Bruning et al. ..... 123/635
5,170,767 A 12/1992 Wada et al. ..... 123/633
5,537,983 A 7/1996 Nakajima ..... 123/635
5,842,458 A 12/1998 Alstrin et al. ..... 123/635
5,951,308 A * 9/1999 Rea ..... 439/125
6,474,322 B1 11/2002 Ubukata et al. ..... 123/634
6,682,357 B2 1/2004 Sikora ..... 439/125

FOREIGN PATENT DOCUMENTS

EP 0508374 4/1992

* cited by examiner

*Primary Examiner*—Mahmoud Gimie
(74) *Attorney, Agent, or Firm*—Taylor & Aust, P.C.

(57) ABSTRACT

The invention in one form is directed to an ignition terminal for coupling an internal combustion engine coil-on-plug ignition coil assembly with a spark plug. The ignition terminal includes an electrical conductor defining a bore therethrough and includes a first end. The first end includes an overlapped member and an overlapping member at least partially overlapping the overlapped member, the overlapped and overlapping members being configured for coupling the first end with the spark plug using the bore. The overlapped and overlapping members are monolithic relative to one another.

16 Claims, 5 Drawing Sheets

COIL-ON-PLUG IGNITION TERMINAL

CROSS REFERENCE TO RELATED APPLICATIONS

This is a non-provisional application based upon U.S. provisional patent application Ser. No. 60/813,833, entitled "COIL ON PLUG IGNITION TERMINAL", filed Jun. 15, 2006.

BACKGROUND OF THE INVENTION

1. Field of the Invention

The present invention relates to ignition systems of internal combustion engines, and, more particularly, to coil-on-plug ignition terminals.

2. Description of the Related Art

Traditionally, in internal combustion engines a single coil is utilized with its high voltage output being directed to separate spark plugs using a distributor assembly. The sparking of the coil is based upon the position of the crankshaft, which is selected to correspond with an ignitable mixture being compressed in a cylinder associated with the respective spark plug. When the engine is in an appropriate position, the points of an electrical circuit can be activated causing the high voltage coil to create an electrical impulse that is then directed to the respective spark plug at the appropriate time as selected by a distributor. As technology has changed, a control system has been introduced such that individual coils can be assigned to each spark plug to spark a single plug upon command of a controller. Such an ignition system, thus, uses a coil-on-plug ignition coil assembly to interact with the spark plug.

An electrical conductor can be used to connect an output of a coil assembly to a spark plug. As provided in U.S. Pat. No. 5,842,458, the conductor can include a tubular element, without an overlap, formed as an end of the conductor, the tubular element receiving an end of the spark plug to form an electrical connection between the conductor and the spark plug. Such a tubular element can be restricted in its ability for selectively connecting with spark plugs of various diameters in a secure manner.

What is needed in the art is a coil-on-plug ignition terminal which is easy to manufacture and to install and which selectively connects with spark plugs of various diameters.

SUMMARY OF THE INVENTION

The present invention provides a coil-on-plug ignition terminal which is easy to manufacture and to install and which selectively connects with spark plugs of various diameters.

The invention in one form is directed to an ignition terminal for coupling an internal combustion engine coil-on-plug ignition coil assembly with a spark plug. The ignition terminal includes an electrical conductor defining a bore therethrough and includes a first end. The first end includes an overlapped member and an overlapping member at least partially overlapping the overlapped member, the overlapped and overlapping members being configured for coupling the first end with the spark plug using the bore. The overlapped and overlapping members are monolithic relative to one another.

The invention in another form is directed to a coil-on-plug ignition system for an internal combustion engine. The ignition system includes a coil-on-plug ignition coil assembly; a spark plug; and an ignition terminal. The ignition terminal includes an electrical conductor defining a bore therethrough and includes a first end and an opposing second end. The first end includes an overlapped member and an overlapping member at least partially overlapping the overlapped member, the overlapped and overlapping members coupling the first end with the spark plug using the bore, the second end coupling with the coil-on-plug ignition coil assembly. The overlapped and overlapping members are monolithic relative to one another.

The invention in yet another form is directed to a method of assembling an ignition system for an internal combustion engine. The method includes the steps of providing, inserting, and connecting. The providing step provides an ignition terminal including an electrical conductor defining a bore therethrough and including a first end and an opposing second end. The first end includes an overlapped member and an overlapping member at least partially overlapping the overlapped member. The overlapped and overlapping members are monolithic relative to one another. The inserting step at least partially inserts a spark plug in the overlapped member. The connecting step connects the first end with the spark plug.

The invention in yet another form is directed to an ignition terminal for coupling an internal combustion engine coil-on-plug ignition coil assembly with a spark plug. The ignition terminal includes an electrical conductor defining a bore therethrough and includes a first end. The first end includes an overlapped member and a spring clip at least partially overlapping the overlapped member, the overlapped member and the spring clip being configured for coupling the first end with the spark plug using the bore. The ignition terminal is without a coil spring.

An advantage of the present invention is its simplicity.

Another advantage is that the ignition terminal can selectively accommodate spark plugs of various diameters.

Yet another advantage is that the ignition terminal can include spark plug and ignition coil connection features which are formed integral relative to the conductive member of the terminal.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
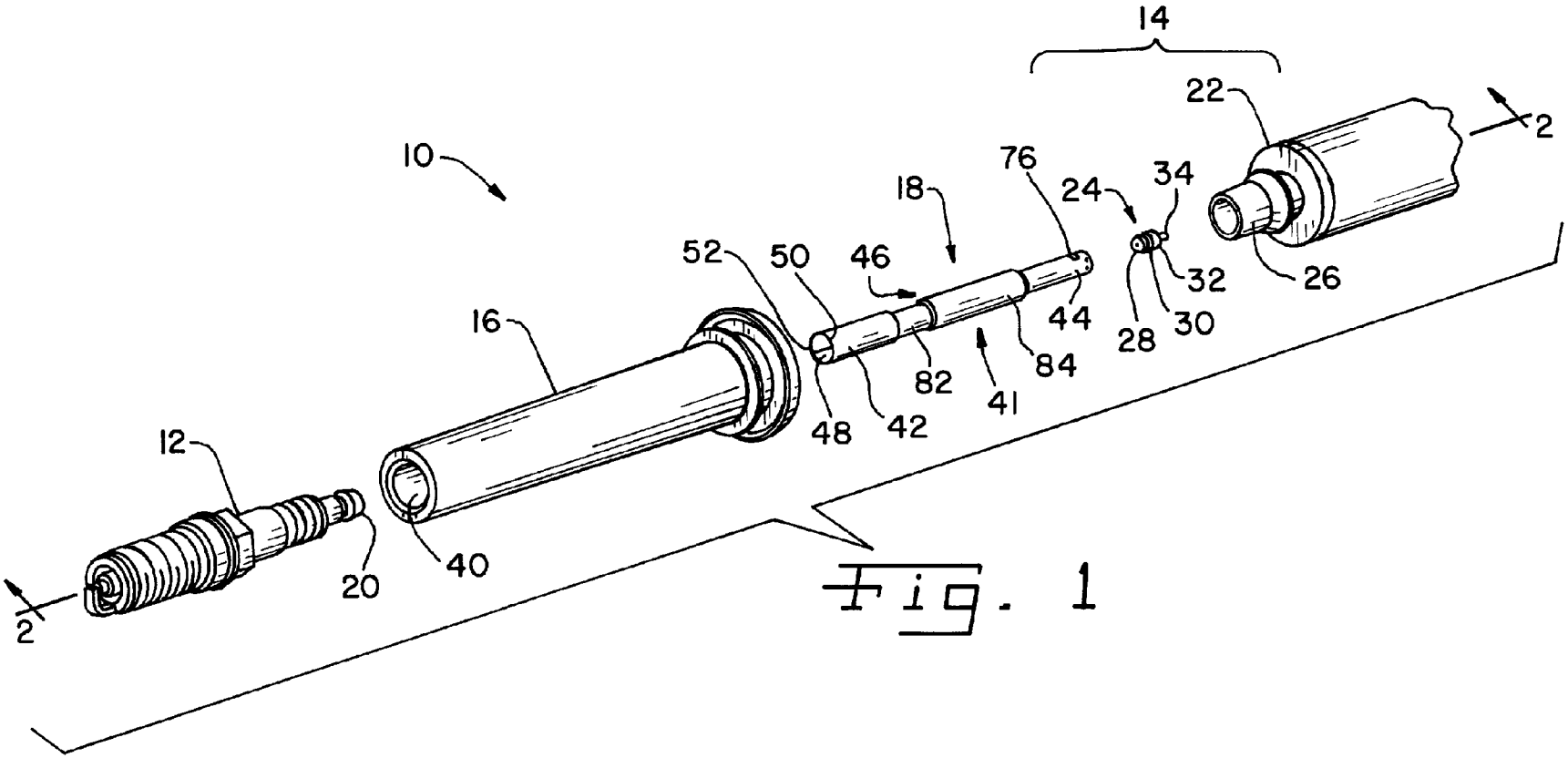
FIG. 1 is an exploded, perspective view of a coil-on-plug ignition system for an internal combustion engine according to the present invention.

Referring now to the drawings, and more particularly to FIGS. 1-5, there is shown a coil-on-plug ("COP") ignition system 10 for an internal combustion engine (not shown). System 10 generally includes a spark plug 12, a COP ignition coil assembly 14, an insulative boot 16, and an ignition terminal 18.

Spark plug 12 includes a first end 20 which is, at least in part, electrically conductive. First end 20 can include a head, a shoulder, and a neck or annular groove between the head and shoulder. The head and shoulder both have a greater diameter or transverse extent than the neck/annular groove. First end 20 is configured for mechanically and electrically connecting with ignition terminal 18.

COP ignition coil assembly 14 includes an ignition coil (not shown), a coil housing 22, and a coil tower 24. The ignition coil generally includes primary and secondary windings (not shown). Coil housing 22 is an external body which houses coil tower 24 and the ignition coil and includes a tubular section 26. Coil tower 24 includes a rounded head 28, a recessed section 30 (such as a neck), a base 32 (such as a shoulder), and a stem 34. Rounded head 28 projects toward ignition terminal 18, and stem 34 projects toward a deeper section of the interior of coil housing 22. Recessed section 30 lies between head 28 and base 32 and includes two generally parallel walls 36 and a linking wall 38 therebetween, parallel walls 36 being generally perpendicular to linking wall 38. Coil tower 24 generally serves to mechanically connect coil housing 22 with an end of terminal 18. Coil tower 24 also serves to electrically connect the ignition coil (such as the secondary winding) to ignition terminal 18.

Insulative boot 16 has a generally cylindrical shape and defines a longitudinal bore 40 therethrough. Bore 40 has a contour which matingly accommodates an external contour of a portion of spark plug 12, an external contour of terminal 18, and an external contour of a portion of coil housing 22 (such as at least a portion of tubular section 26). Boot 16 can be made of a rubber or an elastomeric material. Boot 16 can be mechanically pushed or rolled onto terminal 18, spark plug 12, and/or coil housing 22 so as to accommodate at least a portion of these pieces 12,18,22 in bore 40. Alternatively, boot 16 can be formed on terminal 18 and pushed or rolled onto corresponding portions of spark plug 12 and coil housing 22.

Ignition terminal 18 serves to couple internal combustion engine COP ignition coil assembly 14 with spark plug 12. For instance, ignition coil 18 includes a resilient end for selectively accommodating various diameters of spark plug 12. Ignition terminal 18 includes a generally cylindrical electrical conductor 41 which includes a first end 42, a second end 44 opposing first end 42, a middle portion 46 between first and second ends 42,44, and a hollow bore 48 therethrough running from a terminating edge of first end 42 to a terminating edge of second end 44. First end 42 of conductor 41 generally refers to a lower portion 42 of conductor 41; first end 42 and lower portion 42 can, thus, be used interchangeably herein. Second end 44 generally refers to an upper portion 44 of conductor 41; second end 44 and upper portion 44, thus, can be used interchangeably herein. Conductor 41 provides a complete electrically conductive path from first end 42 to second end 44 (and, thus, from the ignition coil assembly to spark plug 12).

Figure 4:
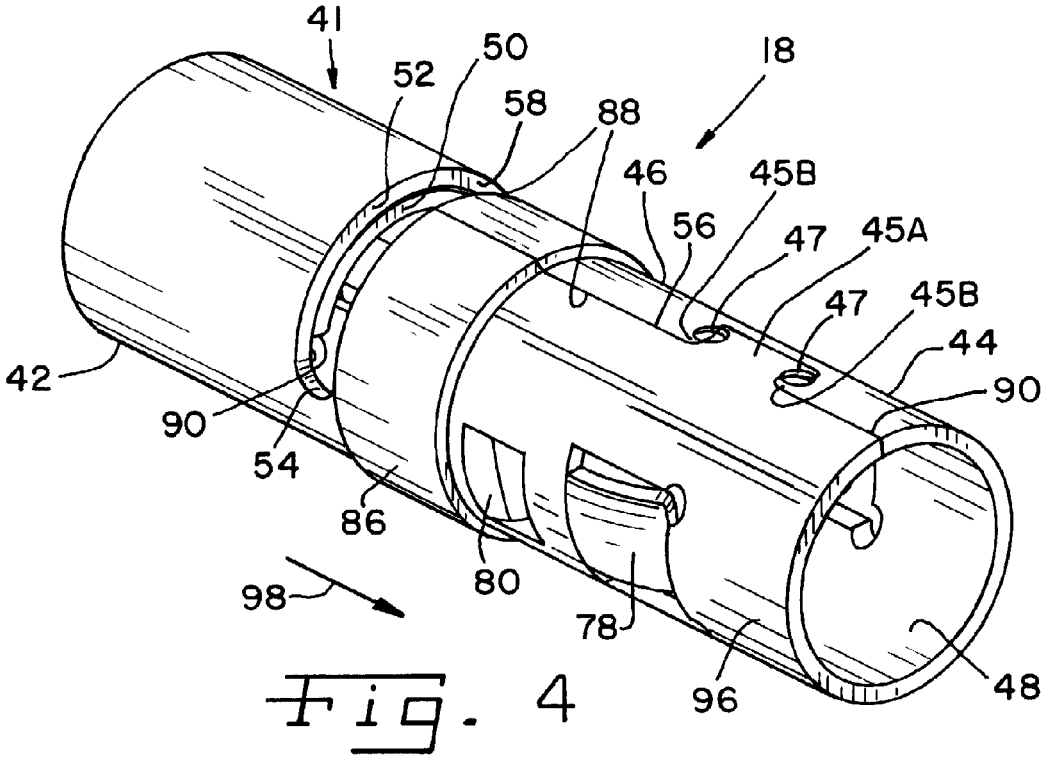
FIG. 4 is a perspective view of another embodiment of the ignition terminal according to the present invention.

In general, terminal 18 can be formed integrally as a single piece or can be formed as a plurality of pieces connected together. Conductor 41 can be formed generally by stamping out a metal blank, forming or rolling the blank into a generally cylindrical shape, and coupling, at least partly, opposing longitudinal sides of the blank. The longitudinal sides of the blank can be coupled together by staking mating locking dovetail portions 45A,45B (which can be formed on upper portion 44 of conductor 41) of the longitudinal sides (staking locations shown at reference number 47), as shown in FIG. 4.

First end 42 of conductor 41 includes an overlapped member 50 and an overlapping member 52 at least partially overlapping overlapped member 52. Overlapped and overlapping members 50,52 couple first end 42 with spark plug 12 using bore 48, while second end 44 couples with COP ignition coil assembly 14. Overlapped member 50 includes essentially that portion of lower portion 42 which is not overlapping member 52.

According to one embodiment of ignition terminal 18, overlapped member 50 and overlapping member 52 can be monolithic relative to one another. That is, overlapped and overlapping members 50,52 can be continuous. Furthermore, conductor 41 includes opposing longitudinal sides 88, 90.

Figure 2:
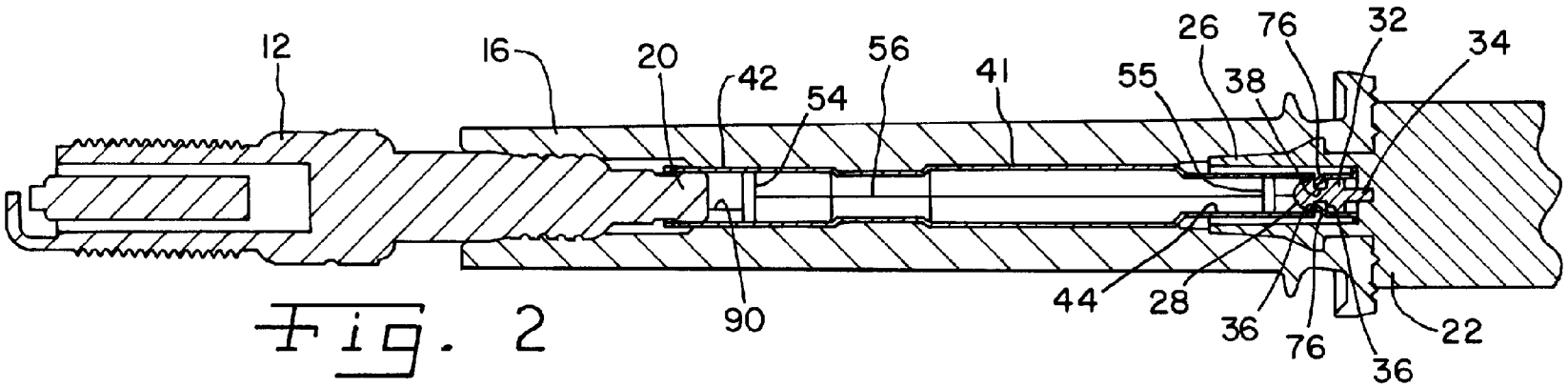
FIG. 2 is a cross sectional view of the coil-on-plug ignition system of FIG. 1 taken along line 2-2.
Figure 3:
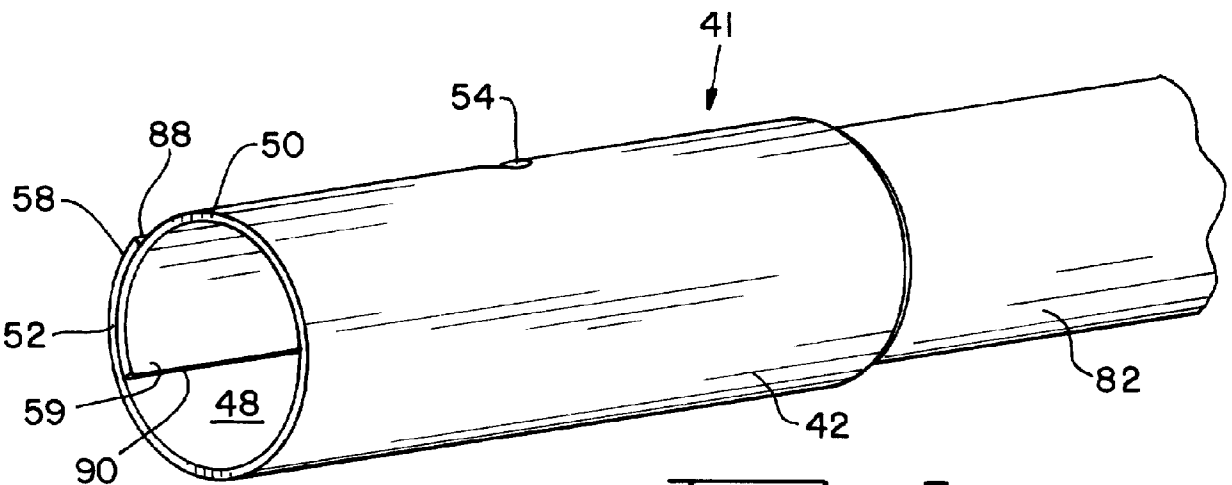
FIG. 3 is a fragmentary, enlarged view of a lower portion of the ignition terminal of FIG. 1.

Overlapped and overlapping members 50,52 are generally formed when the blank is rolled so as to generally form a cylinder. The overlap is formed because, in the flat or unrolled state, the blank is not completely rectangular. Stated another way, the blank generally can have the shape of a rectangle but for longitudinal side 88 (the blank can include for stamping purposes a cutout 54 in or near lower portion 42 as shown in FIGS. 2 and 3, as well as a similar type of cutout 55 in upper portion 44 as shown in FIGS. 1 and 2). Regarding longitudinal side 88, upper and middle portions 44,46 (which are not offset from each other) are offset from lower portion 42. The offset is such that, as an unrolled blank, lower portion 42 is wider than upper/middle portions 44,46 in a direction which is transverse to the longitudinal direction 98 of the cylindrical conductor 41. That is, the offset longitudinal side 88 along lower portion 42 extends farther away from opposing longitudinal side 90 than does longitudinal side 88 along upper/middle portions 44,46, longitudinal side 90 not being offset from itself in this embodiment of lower portion 42. Thus, when the blank is rolled and longitudinal sides 88,90 of upper/middle portions 44,46 of the blank join together forming a seam 56, longitudinal sides 88,90 of lower portion 42 do not join together so as to form such a seam. Seam 56 simply describes a relative coming together of opposed longitudinal sides 88,90; seam 56 does not mean that opposing longitudinal sides 88, 90 are necessarily adhered together. For instance, longitudinal sides 88,90 forming seam 56 in FIG. 4 are not adhered together except at mating dovetail portions 45A,45B, mating dovetail portions 45A,45B being adhered together by staking. Alternatively, longitudinal sides 88,90 forming seam 56 may be adhered together.

The transverse extent of lower portion 42 (the distance between longitudinal sides 88, 90 of lower portion 42) is, thus, too wide (forming an excess) for longitudinal sides 88,90 of lower portion 42 to join together at a seam and for bore 48 to essentially retain a diameter equal to the bore 48 diameter of middle and upper portions 44,46 of conductor 41. The overlapping member 52, thus, is an extension of overlapped member 50. Consequently, when the blank is rolled into a cylinder, lower portion 42 overlaps itself, such that the inner radius of overlapping member 52 (measured from an inner surface of overlapping member 52) is greater than the outer radius of overlapped member 50 (measured from an outer surface of overlapped member 50). In so overlapping, the inner surface of overlapping member 52 generally contacts the outer surface of overlapped member 50. This sort of overlap causes lower portion 42 to act as a spring, to expand when spark plug 12 is inserted in first end 42, and to provide a biasing force directed generally radially inwardly.

Alternatively, longitudinal side 90 can also be offset from itself. That is, longitudinal side 90 can be offset in a similar manner that longitudinal side 88 is offset from itself. Thus, longitudinal side 90 along lower portion 42 may extend circumferentially farther from a longitudinally extending center line than longitudinal side 90 along upper/middle portions 44,46, the center line being located on the body 96 of conductor 41. As with the offset described relative to longitudinal side 88, the offset relative to longitudinal side 90 extends in a direction circumferentially transverse to the longitudinal direction of terminal 18 after the blank has been rolled to form conductor 41. Accordingly, in a single embodiment of terminal 18, each longitudinal side 88,90 can be offset from itself, as shown in FIG. 4. The amount of offset between longitudinal sides 88,90, however, can differ; in other words, for example, longitudinal side 88 may be offset to a greater extent than longitudinal side 90.

Overlapping member 52 can include a free terminating end 58, which is associated with the terminating edge of overlapping member 52 and longitudinal side 88. Free terminating end 58 can move positions or float relative to the outer surface of overlapped member 50 because free terminating end 58 is not fixedly attached to the outer surface of overlapped member 50. Thus, overlapping member 52 is connected to overlapped member 50 in the sense that overlapping member 52 is continuous with and is an extension of (thus, forming the excess) overlapped member 50 but is not connected to overlapped member 50 at free terminating end 58.

Similarly, overlapped member 50 can also include a free terminating end 59, which is associated with the terminating edge of overlapped member 50 and longitudinal side 90. That is, free terminating end 59 can float relative to the inner surface of overlapping member 52 because free terminating end 59 is not fixedly attached to the inner surface of overlapping member 52.

Figure 5:
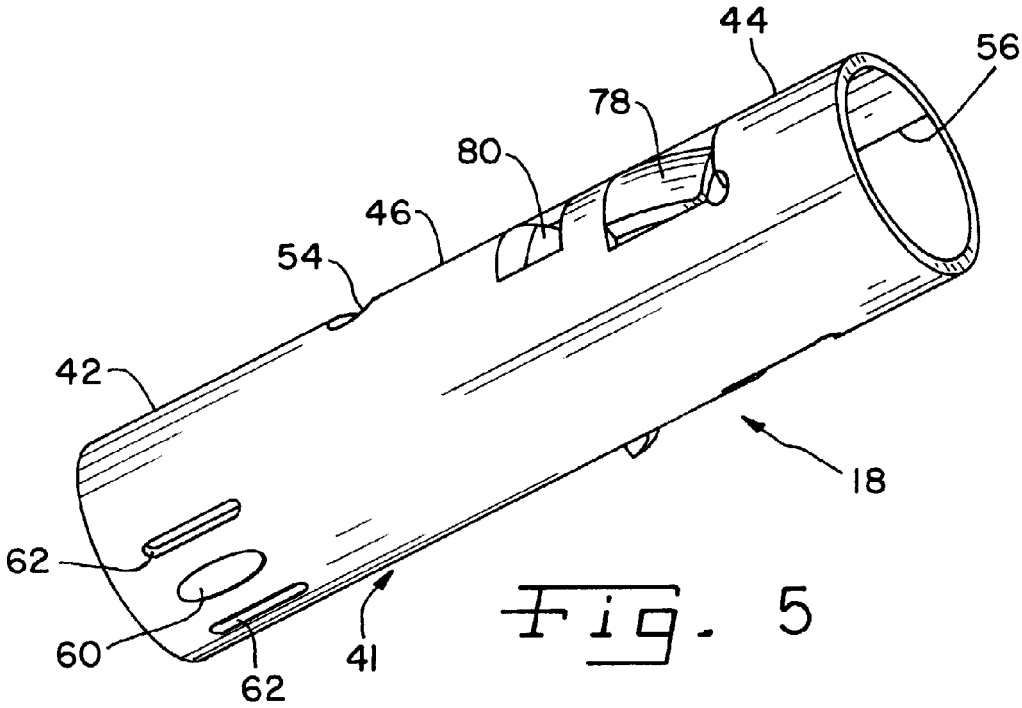
FIG. 5 is a perspective view of the embodiment of the ignition terminal of FIG. 4 without the rubber retention device on the middle portion of the ignition terminal.

Overlapped member 50 can further include at least one inwardly extending dimple 60 connecting first end 42 to spark plug 12. Dimple 60, shown in FIG. 5, is positioned on an inside surface of overlapped member 50. Dimple 60 interacts with the head, shoulder, and neck/annular groove of spark plug 12 when spark plug 12 is inserted in bore 48 of first end 42. That is, the head of spark plug 12 can be inserted to such a depth that the head passes dimple 60 and dimple 60 comes to rest in the neck/annular groove. As such, dimple 60 and the head of spark plug 12 serve to secure spark plug 12 to first end 42 by requiring more extraction force (than may be the case without a dimple) to disconnect spark plug 12 from first end 42. Furthermore, dimple 60 and the shoulder of spark plug 12 work together so as to restrict spark plug 12 from being inserted to an even greater depth in bore 48 of conductor 41.

Dimple 60 can be generally hemispherically-shaped, oval-shaped, or have a general ramp-like or tear-drop shape. Dimple 60 can be the same as or similar to the dimples described in U.S. Pat. No. 6,682,357 (i.e., dimples 56 and 58 in U.S. Pat. No. 6,682,357); U.S. Pat. No. 6,682,357 is incorporated by reference herein. The ramp-like or tear-drop dimple 60 can be inverted. That is, the gently rising slope of the ramp/tear-drop can be positioned closer to the terminating edge of first end 42 than the steep slope of the ramp/tear-drop. The gently rising slope, then, provides for ease of insertion of the head of spark plug 12 beyond dimple 60. The steep slope of the inverted ramp/tear-drop provides for a higher extraction force relative to the insertion force. Alternatively, the ramp/tear-drop may not be inverted and, thus, may be right-side-up such that the steep slope is positioned closer to the terminating edge of first end 42 than the gently rising slope.

Overlapped member 50 may also include at least one slot 62 having a longitudinal direction generally parallel to the longitudinal direction 98 of ignition terminal 18. Each slot 62 defines a hole through conductor 41, as shown in FIG. 5. A plurality of slots 62 can be positioned around the circumference of first end 42. Dimple 60 can be placed between a plurality of slots 62. Slots 62 can serve to allow dimple 60 to spring or snap out when spark plug 12 is inserted in first end 42, thereby lowering the insertion force of spark plug 12 into conductor 41 when overlapped member 50 includes dimple 60. Slots 62 can also be included when dimple 60 is not included.

Figure 6:
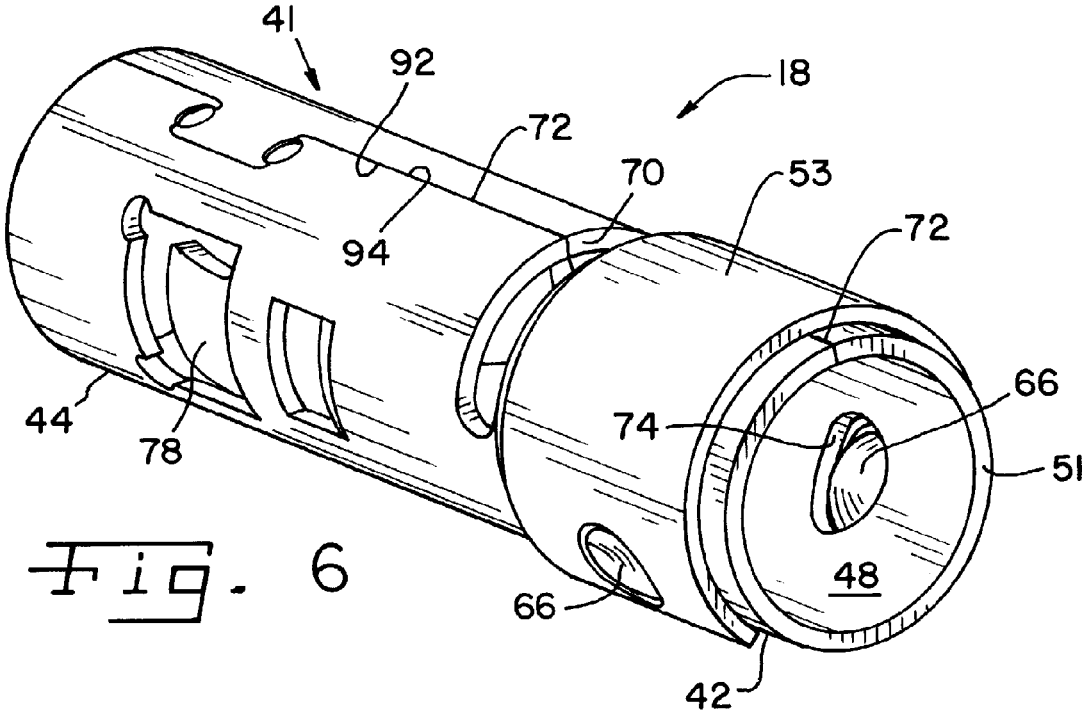
FIG. 6 is a perspective view of another embodiment of the ignition terminal according to the present invention.
Figure 7:
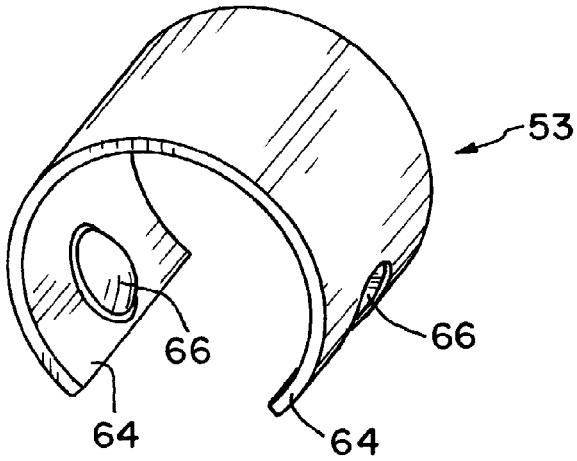
FIG. 7 is a perspective view of the clip of the embodiment of the ignition terminal of FIG. 6.
Figure 8:
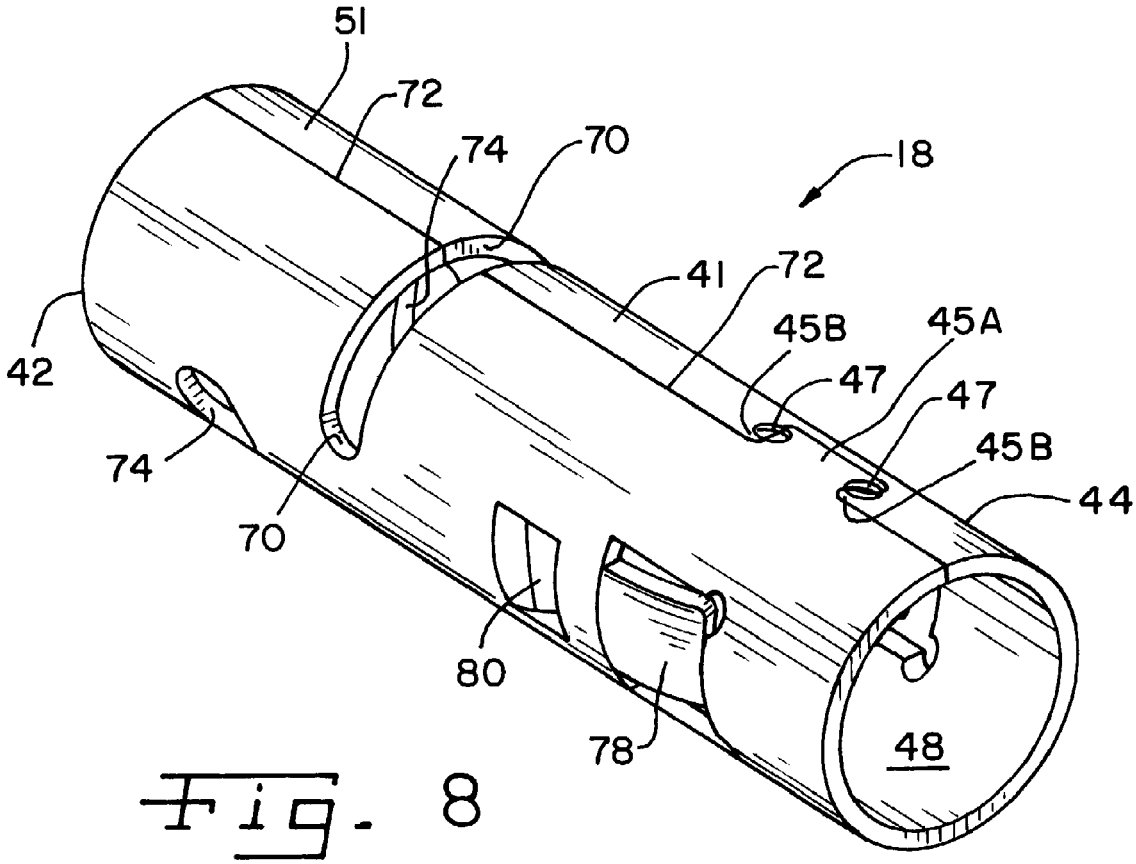
FIG. 8 is a perspective view of the of the ignition terminal of FIG. 6 without the clip.

According to another embodiment of first end 42 of conductor 41 (as shown in FIGS. 6-8), overlapped member 51 and overlapping member 53 are detachable relative to one another (upper and middle portions 44,46 of conductor 41 can be as described below). In this alternative embodiment of first end 42, overlapping member 53 can be a spring clip 53 generally having a C-shape. More specifically, clip 53 has a generally circular transverse cross section and includes two opposing terminating ends 64 spanned by a gap. Clip 53 also includes at least one inwardly extending dimple 66 on an inner surface of clip 53. Dimple 66 can have the same or similar shape as that described relative to dimple 60 herein. For instance, dimple 66 can be the same as or similar to the dimples described in U.S. Pat. No. 6,682,357 (i.e., dimples 56 and 58 in U.S. Pat. No. 6,682,357); U.S. Pat. No. 6,682,357 is incorporated by reference herein. Overlapped member 51 has a generally cylindrical shape including two longitudinal sides 92,94 coaxial with longitudinal sides of upper and middle portions 44,46. That is, the blank stamped to form conductor 41 (less clip 53) has a generally rectangular shape prior to rolling the blank into a cylinder (although for stamping purposes, the blank can include a cutout 70 in or near lower portion 42). Upon rolling the blank, longitudinal sides 92,94 of lower, upper, and middle portions 42,44,46 join together and generally form a common seam 72. Seam 72 simply describes a relative coming together of opposed longitudinal sides 92, 94; seam 72 does not mean that the opposing longitudinal sides 92,94 are necessarily adhered together. For instance, longitudinal sides 92,94 forming seam 72 in FIGS. 6 and 8 are not adhered together except at the single mating dovetail portions 45A,45B shown in upper portion 44, mating dovetail portions 45A,45B being adhered together by staking. As such, lower portion 42 can expand along seam 72; stated another way, longitudinal sides 92,94 forming seam 72 of lower portion 42 can separate, to a degree, during insertion of spark plug 12.

Overlapped member 51 further includes at least one through-hole 74. Through-hole 74 and dimple 66 are complementary in shape. Through-hole 74, thus, can have a generally circular shape, an oval shape, or a shape which accommodates a ramp-like or tear-drop-shaped dimple 66. Clip 53 mounts to overlapped member 51 and thereby overlaps overlapped member 51, such that the inner surface of clip 53 generally contacts an outer surface of overlapped member 51. Clip 53 can be flexible enough to mount overlapped member 51 and also be biased such that clip 53 firmly holds to overlapped member 51 when mounted and securely holds overlapped member 51 to spark plug 12. In mounting clip 53 to overlapped member 51, dimple 66 of clip 53 protrudes through hole 74 of overlapped member 51 in a radially inward direction. In so doing, dimple 66 connects first end 42 to spark plug 12 in a manner similar to the interaction of dimple 60 and spark plug 12 described above. Ignition terminal 18 can be without a coil spring coupled with spark plug 12 and/or COP ignition coil assembly 14.

Second end 44 of conductor 41 includes a plurality of locking tabs 76 for coupling coil tower 24 with second end 44 of conductor 41, as shown in FIGS. 1-2. Each locking tab 76 has a generally square shape and can be cut and/or lanced from the body of conductor 41. Three sides of each tab 76 can be cut from the body of conductor 41, leaving one side of tab 76 intact (integral) with the body of conductor 41. The square shape can have two sides running generally parallel with the longitudinal axis of terminal 18 and two sides (which can be referred to as the transversely extending sides) generally perpendicular to the two longitudinally extending sides. The integral side of locking tab 76 can be the transversely extending side which is nearest the terminating edge of second end 44 of conductor 41 (that is, nearest COP ignition coil assembly 14). Each tab 76 is, then, bent inwardly (into bore 48), the integral side of locking tab 76 serving as the fold or bend line. As such, locking tabs 76 serve to mechanically couple with coil tower 24 by resting within recessed section 30 of coil tower 24 after coil tower 24 has been inserted in bore 48 of second end 44 of conductor 41.

In another embodiment of second end 44, second end 44 can include locking fingers 78 and stop tabs 80, as shown in FIGS. 4-6 and 8. Locking fingers 78 and stop tabs 80 work in conjunction with one or more connection features (not shown) of another embodiment of COP ignition coil assembly (not shown). Locking fingers 78 serve to restrict disconnection of terminal 41 from the coil assembly, and stop tabs 80 serve to restrict the coil assembly from being inserted too deeply into bore 48 of conductor 41.

Middle portion 46 of conductor 41 can be shaped so as to securely engage boot 16. In one embodiment (FIGS. 1-3), middle portion 46 can include a recessed section 82 and a raised section 84, recessed section 82 being recessed relative to lower portion 42 and raised section 84 of middle portion 46, raised section 84 of middle portion 46 being raised relative to recessed section 82 and upper portion 44. Raised section 84 can be formed integral with conductor 41 or can be a rubber or elastomeric retention device coupled to conductor 41. Raised section 84 can be configured for coupling conductor 41 with boot 16. In another embodiment (FIG. 4), middle portion 46 can include a raised section 86 relative to upper and lower portions 42,44, raised section 86 being formed by a rubber retention device coupled with conductor 41; rubber retention device 86 can be coupled with conductor 41 and configured for coupling conductor 41 with boot 16. In another embodiment (FIGS. 5, 6, and 8), middle portion 46 can be level (neither raised nor recessed) relative to upper and lower portions 42,44.

In use, an ignition system 10 for an internal combustion engine can be assembled by providing an ignition terminal 18 according to any of the embodiments described above. Conductor 41 is stamped and formed. Conductor 41 can be inserted in boot 16 and securely coupled together via recessed and/or raised sections of conductor 41.

Spark plug 12 is at least partially inserted in overlapped member 50 of conductor 41. First end 42 of conductor 41 is then connected with spark plug 12. In so doing, a portion of spark plug 12 can also be inserted in a spark plug end of boot 16. According to the embodiment of lower portion 42 of conductor 41 as shown in FIGS. 1-5, lower portion 42 can expand during insertion of spark plug 12 in bore 48 of lower portion 42. The biasing force of lower portion 42 serves to compress lower portion 42 onto terminal connective portion of spark plug 12. Further, if lower portion 42 includes dimple 60, lower portion 42 can expand to a greater extent (than without dimple 60) until dimple 60 comes to rest in the neck or annular groove of spark plug 12, at which point lower portion 42 contracts so as to secure the connection between conductor 41 and spark plug 12. Overlapped and overlapping members 50,52, thus, expand and contract as necessary so as to facilitate the insertion of spark plug 12 in lower portion 42 and to secure spark plug 12 to lower portion 42.

According to the embodiment of lower portion 42 of conductor 41 involving clip 53 as shown in FIGS. 6-8, the insertion of spark plug 12 in first end 42 can cause first end 42 to expand along seam 72 (that is, the longitudinal sides forming seam 72 in first end 42 can separate). Without clip 53, then, lower end 42 may not securely couple with spark plug 12. Thus, clip 53 is mounted to first end 42. Given the biasing force of overlapped member 51 without clip 53 and the biasing force of clip 53, lower end 42 securely couples with spark plug 12. In mounting clip 53 to overlapped member 51, clip 53 can be pressed onto overlapped member 51 after placing terminating ends 64 of clip 53 on the body of overlapped member 51. After pressing clip 53 onto overlapped member 51, clip 53 can be positioned so that dimple 66 protrudes through hole 74. Upon doing so, spark plug 12 can be inserted in bore 48 of first end 42 until dimples 66 comes to rest in the neck or annular groove of spark plug 12, overlapped member 51 and clip 53 expanding and contracting as necessary so as to facilitate the insertion of spark plug 12 in lower portion 42 and to secure spark plug 12 to lower portion 42.

The assembly of ignition system 10 also includes connecting second end 44 of conductor 41 with COP ignition coil assembly 14. According to the embodiment of terminal assembly 18 shown in FIGS. 1-2, coil tower 24 can be inserted, head 28 first, into bore 48 of second end 44 until locking tabs 76 come to rest in recessed section 30 of coil tower 24. Locking tabs 76, thus, project into recessed section 30 and are hindered from exiting recessed section 30 by parallel walls 36. When inserting coil tower 24 in bore 48 of conductor 41, tubular section 26 of coil housing 22 generally overlaps a portion of second end 44 of conductor 41. Furthermore, at least a portion of tubular section 26 can itself be overlapped by and secured to boot 16.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ignition terminal for coupling an internal combustion engine coil-on-plug ignition coil assembly with a spark plug, said ignition terminal comprising:

an electrical conductor defining a bore therethrough and including a first end, said first end including an overlapped member and an overlapping member at least partially overlapping said overlapped member, said overlapped and overlapping members configured for coupling said first end with the spark plug using said bore, said overlapped and overlapping members being monolithic relative to one another, said overlapped member having longitudinal sides that are adhered together by way of a mating dovetail.

2. The ignition terminal of claim 1, wherein said overlapping member includes a free terminating end.

3. The ignition terminal of claim 2, wherein said overlapped member includes at least one inwardly extending dimple configured for connecting said first end to the spark plug.

4. The ignition terminal of claim 1, wherein said electrical conductor further includes two longitudinal sides, each longitudinal side being offset from itself.

5. The ignition terminal of claim 1, wherein said longitudinal sides are not adhered together except by way of said mating dovetail.

6. A coil-on-plug ignition system for an internal combustion engine, said ignition system comprising:

a coil-on-plug ignition coil assembly;

a spark plug; and an ignition terminal including an electrical conductor defining a bore therethrough and including a first end and an opposing second end, said first end including an overlapped member and an overlapping member at least partially overlapping said overlapped member, said overlapped and overlapping members coupling said first end with said spark plug using said bore, said second end coupling with said coil-on-plug ignition coil assembly, said overlapped and overlapping members being monolithic relative to one another, said overlapped member having longitudinal sides that are adhered together by way of a mating dovetail.

7. The ignition system of claim 6, wherein said overlapping member includes a free terminating end.

8. The ignition system of claim 7, wherein said overlapped member includes at least one inwardly extending dimple connecting said first end to the spark plug.

9. The ignition system of claim 6, wherein said electrical conductor further includes two longitudinal sides, each longitudinal side being offset from itself.

10. A method of assembling an ignition system for an internal combustion engine, said method comprising the steps of:

providing an ignition terminal including an electrical conductor defining a bore therethrough and including a first end and an opposing second end, said first end including an overlapped member and an overlapping member at least partially overlapping said overlapped member, said overlapped and overlapping members being monolithic relative to one another;

at least partially inserting a spark plug in said overlapped member; and connecting said first end with said spark plug, said overlapped member having longitudinal sides that are adhered together by way of a mating dovetail.

11. The method of claim 10, wherein said overlapping member includes a free terminating end.

12. The method of claim 11, wherein said overlapped member includes at least one inwardly extending dimple connecting said first end to said spark plug.

13. The method of claim 10, wherein said electrical conductor further includes two longitudinal sides, each longitudinal side being offset from itself.

14. The method of claim 10, further comprising the step of connecting said second end with a coil-on-plug ignition coil assembly.

15. An ignition terminal for coupling an internal combustion engine coil-on-plug ignition coil assembly with a spark plug, said ignition terminal comprising:

an electrical conductor defining a bore therethrough and including a first end, said first end including an overlapped member and a spring clip at least partially overlapping said overlapped member, said overlapped member and said spring clip configured for coupling said first end with the spark plug using said bore, said ignition terminal being without a coil spring, said overlapped member having longitudinal sides that are adhered together by way of a mating dovetail.

16. The ignition terminal of claim 15, wherein said overlapped member and said spring clip are detachable relative to one another, said spring clip including a dimple, said overlapped member including a hole, said dimple protruding through said hole and being configured for connecting said first end to the spark plug.

* * * * *